US010941669B2

(12) United States Patent
Hough et al.

(10) Patent No.: US 10,941,669 B2
(45) Date of Patent: Mar. 9, 2021

(54) DIFFUSER CASE SUPPORT STRUCTURE

(71) Applicant: United Technologies Corporation, Farmington, CT (US)

(72) Inventors: Matthew A. Hough, Simsbury, CT (US); Russell B. Hanson, Jupiter, FL (US); John S. Tu, West Hartford, CT (US); Paul F. Croteau, Columbia, CT (US); Paul K. Sanchez, Wellington, FL (US); Stephen C. Harmon, East Hampton, CT (US); Joshua C. Rathgeb, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 136 days.

(21) Appl. No.: 16/228,994

(22) Filed: Dec. 21, 2018

(65) Prior Publication Data

US 2020/0200028 A1 Jun. 25, 2020

(51) Int. Cl.
*F01D 9/06* (2006.01)
*F01D 9/02* (2006.01)
*F01D 25/24* (2006.01)

(52) U.S. Cl.
CPC ..... *F01D 9/065* (2013.01); *F01D 9/02* (2013.01); *F01D 25/24* (2013.01); *F05D 2240/12* (2013.01); *F05D 2240/91* (2013.01)

(58) Field of Classification Search
CPC . F01D 9/02; F01D 9/065; F01D 25/12; F01D 25/125; F01D 25/162; F01D 25/26; F05D 2240/15; F05D 2250/36; F05D 2260/30
See application file for complete search history.

(56) References Cited

U.S. PATENT DOCUMENTS 4,979,872 A * 12/1990 Myers ..... F01D 9/065 403/131
4,987,736 A * 1/1991 Ciokajlo ..... F01D 9/065 415/138
5,160,251 A * 11/1992 Ciokajlo ..... F01D 25/162 415/142
5,292,227 A 3/1994 Czachor
5,609,467 A 3/1997 Lenhart et al.
8,561,410 B2 10/2013 Mulcaire
10,087,775 B2 10/2018 Mulcaire
(Continued)

FOREIGN PATENT DOCUMENTS

GB 2281592 A 3/1995

OTHER PUBLICATIONS

EP search report for EP!9204409.7 dated May 27, 2020.

*Primary Examiner* — Igor Kershteyn
(74) *Attorney, Agent, or Firm* — Getz Balich LLC

(57) ABSTRACT

A diffuser case support structure for a gas turbine engine is disclosed. The diffuser case support structure includes a fairing disposed circumferentially about a longitudinal axis. The fairing forms at least a portion of a fluid path between a compressor and a combustor of the gas turbine engine. The fairing defines a plurality of apertures extending through the fairing. At least one spoke extends through at least one respective aperture of the plurality of apertures. The at least one spoke is configured to couple an inner diffuser case and an outer diffuser case of the gas turbine engine.

20 Claims, 5 Drawing Sheets

(56) References Cited

U.S. PATENT DOCUMENTS

| | | | | |
|---|---|---|---|---|
| 2009/0142182 | A1* | 6/2009 | Kapustka | F01D 25/162<br>415/142 |
| 2010/0275572 | A1* | 11/2010 | Durocher | F01D 25/18<br>60/39.08 |
| 2013/0052006 | A1* | 2/2013 | Petty | F01D 25/28<br>415/213.1 |
| 2013/0094951 | A1* | 4/2013 | McCaffrey | F01D 25/246<br>415/200 |
| 2014/0013771 | A1* | 1/2014 | Farah | F02C 7/20<br>60/797 |
| 2014/0102110 | A1 | 4/2014 | Farah | |
| 2015/0260057 | A1 | 9/2015 | Farah | |
| 2015/0354411 | A1 | 12/2015 | Scott | |
| 2016/0090914 | A1 | 3/2016 | Lyons | |

* cited by examiner

DIFFUSER CASE SUPPORT STRUCTURE

This invention was made with Government support awarded by the United States. The Government has certain rights in this invention.

BACKGROUND

1. Technical Field

This disclosure relates generally to gas turbine engines, and more particularly to diffuser case assemblies.

2. Background Information

During operation of a gas turbine engine, heated core gases flow from a compressor section to a combustor section where they are mixed with fuel and ignited. Elevated core gas temperatures may induce large thermal gradients on engine components in the core flowpath.

For example, during a transient acceleration from idle to takeoff power, a support structure for an inner diffuser case, forming part of the core flowpath, may rapidly reach takeoff metal temperatures. The resulting thermal gradient may create excessive stress concentrations at intersections of comparatively hotter and colder portions of the diffuser cases and associated support structure. The thermal stress concentrations are exacerbated by the need for the inner diffuser case structure to be stiff enough to support a shaft bearing of the gas turbine engine.

SUMMARY

According to an embodiment of the present disclosure, a diffuser case support structure for a gas turbine engine is disclosed. The diffuser case support structure includes a fairing disposed circumferentially about a longitudinal axis. The fairing forms at least a portion of a fluid path between a compressor and a combustor of the gas turbine engine. The fairing defines a plurality of apertures extending through the fairing. At least one spoke extends through at least one respective aperture of the plurality of apertures. The at least one spoke is configured to couple an inner diffuser case and an outer diffuser case of the gas turbine engine.

In the alternative or additionally thereto, in the foregoing embodiment, the fairing defines a plurality of channels. The plurality of channels form the at least a portion of the fluid path between the compressor and the combustor.

In the alternative or additionally thereto, in the foregoing embodiment, each aperture of the plurality of apertures is disposed between each respective pair of circumferentially adjacent channels of the plurality of channels.

In the alternative or additionally thereto, in the foregoing embodiment, the at least one spoke comprises a plurality of spokes.

In the alternative or additionally thereto, in the foregoing embodiment, each spoke of the plurality of spokes extends through a respective one of the plurality of apertures.

In the alternative or additionally thereto, in the foregoing embodiment, the at least one spoke is physically independent of the fairing.

In the alternative or additionally thereto, in the foregoing embodiment, the at least one spoke is made of a first material and the fairing is made of a second material, different than the first material.

In the alternative or additionally thereto, in the foregoing embodiment, the diffuser case support structure further includes at least one seal disposed between the fairing and at least one of the inner diffuser case and the outer diffuser case.

In the alternative or additionally thereto, in the foregoing embodiment, the diffuser case support structure further includes a sliding joint forming an interface between the fairing and at least one of the inner diffuser case and the outer diffuser case.

In the alternative or additionally thereto, in the foregoing embodiment, the sliding joint is configured to move radially in response to at least one of thermal expansion and contraction of the fairing in a radial direction.

In the alternative or additionally thereto, in the foregoing embodiment, the at least one spoke is hollow along at least a portion of a radial length of the at least one spoke.

In the alternative or additionally thereto, in the foregoing embodiment, the at least one spoke is configured to conduct a flow of fluid.

In the alternative or additionally thereto, in the foregoing embodiment, an auxiliary line extends through an aperture of the plurality of apertures.

In the alternative or additionally thereto, in the foregoing embodiment, the fairing is a single-piece casting.

According to another embodiment of the present disclosure, a diffuser case support structure for a gas turbine engine is disclosed. The diffuser case support structure includes a fairing disposed circumferentially about a longitudinal axis. The fairing defines a plurality of apertures extending through the fairing and a plurality of channels extending through the fairing. The plurality of channels form at least a portion of a fluid path between a compressor and a combustor of the gas turbine engine. At least one spoke extends through at least one respective aperture of the plurality of apertures. The at least one spoke is configured to couple an inner diffuser case and an outer diffuser case of the gas turbine engine.

In the alternative or additionally thereto, in the foregoing embodiment, each aperture of the plurality of apertures is disposed between each respective pair of circumferentially adjacent channels of the plurality of channels.

In the alternative or additionally thereto, in the foregoing embodiment, the at least one spoke is physically independent of the fairing.

According to another embodiment of the present disclosure, a gas turbine engine is disclosed. The gas turbine engine includes an inner diffuser case, an outer diffuser case, and a diffuser case support structure. The diffuser case support structure includes a fairing disposed circumferentially about a longitudinal axis. The fairing forms at least a portion of a fluid path between a compressor and a combustor of the gas turbine engine. The fairing defines a plurality of apertures extending through the fairing. At least one spoke extends through at least one respective aperture of the plurality of apertures. The at least one spoke is configured to couple the inner diffuser case to the outer diffuser case.

In the alternative or additionally thereto, in the foregoing embodiment, the fairing includes a plurality of channels. The plurality of channels form the at least a portion of the fluid path between the compressor and the combustor.

In the alternative or additionally thereto, in the foregoing embodiment, the at least one spoke is physically independent of the fairing.

The present disclosure, and all its aspects, embodiments and advantages associated therewith will become more readily apparent in view of the detailed description provided below, including the accompanying drawings.

DETAILED DESCRIPTION

Figure 1:
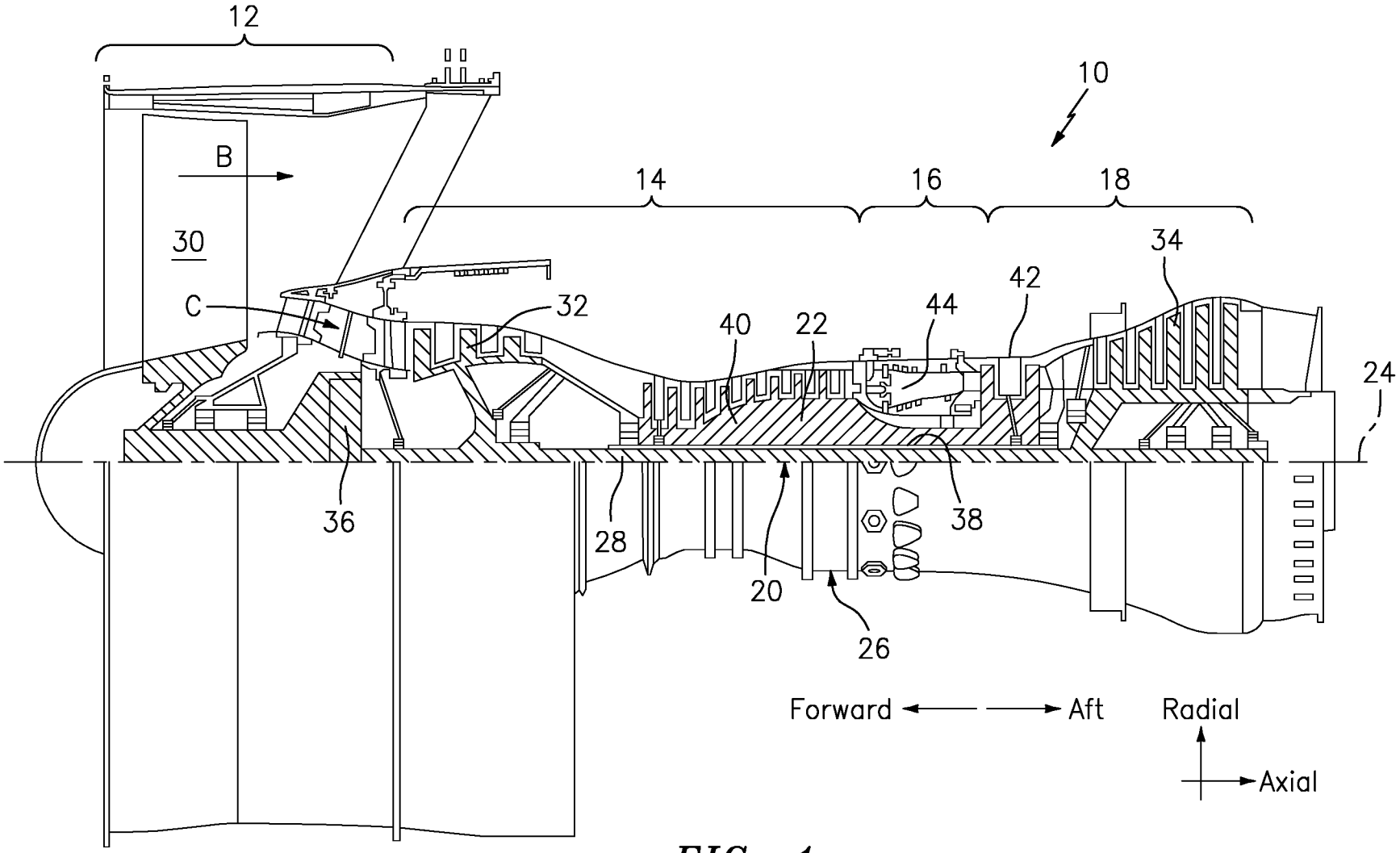
FIG. 1 is a schematic cross-section of a gas turbine engine.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

FIG. 1 schematically illustrates a gas turbine engine 10. The gas turbine engine 10 is disclosed herein as a two-spool turbofan that generally incorporates a fan section 12, a compressor section 14, a combustor section 16, and a turbine section 18. The fan section 12 drives air along a bypass flowpath B while the compressor section 14 drives air along a core flowpath C for compression and communication into the combustor section 16 then expansion through the turbine section 18. Although depicted as a turbofan gas turbine engine in the disclosed non-limiting embodiment, it should be understood that the concepts described herein are not limited to use with turbofans as the teachings may be applied to other types of turbine engines including three-spool architectures.

The gas turbine engine 10 generally includes a low-speed spool 20 and a high-speed spool 22 mounted for rotation about an engine central longitudinal axis 24 relative to an engine static structure 26. It should be understood that various bearing systems at various locations may alternatively or additionally be provided.

The low-speed spool 20 generally includes an inner shaft 28 that interconnects a fan 30, a low-pressure compressor 32 and a low-pressure turbine 34. The inner shaft 28 is connected to the fan 30 through a geared architecture 36 to drive the fan 30 at a lower speed than the low-speed spool 20. The high-speed spool 22 includes an outer shaft 38 that interconnects a high-pressure compressor 40 and high-pressure turbine 42. A combustor 44 is arranged between the high-pressure compressor 40 and high-pressure turbine 42.

The core airflow is compressed by the low-pressure compressor 32 then the high-pressure compressor 40, mixed and burned with fuel in the combustor 44, then expanded over the high-pressure turbine 42 and the low-pressure turbine 34. The turbines rotationally drive the respective low-speed spool 20 and high-speed spool 22 in response to the expansion.

Figure 2:
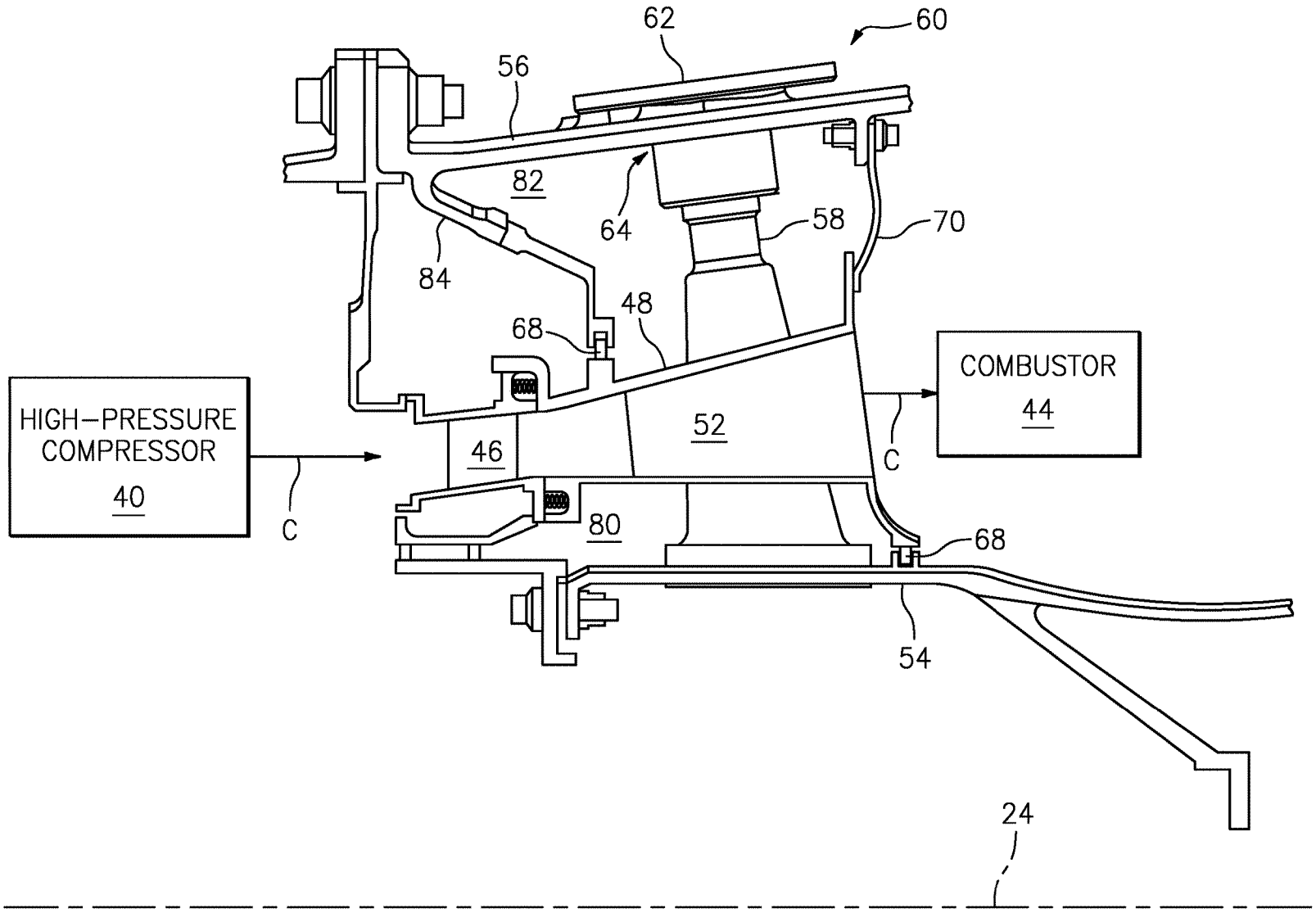
FIG. 2 is a cross-sectional side view of a diffuser case assembly of a gas turbine engine.
Figure 3:
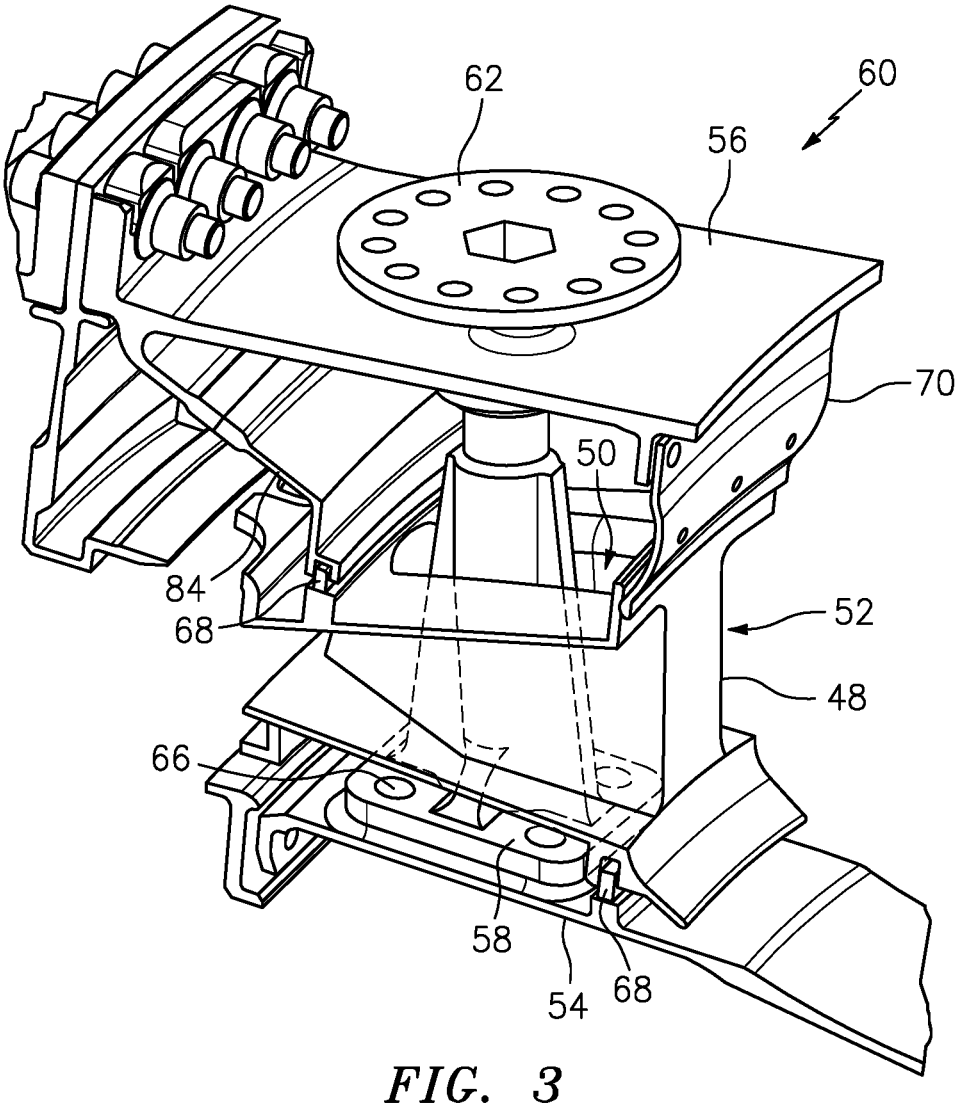
FIG. 3 is a cross-sectional perspective view of a portion of the diffuser case assembly of FIG. 2.
Figure 4:
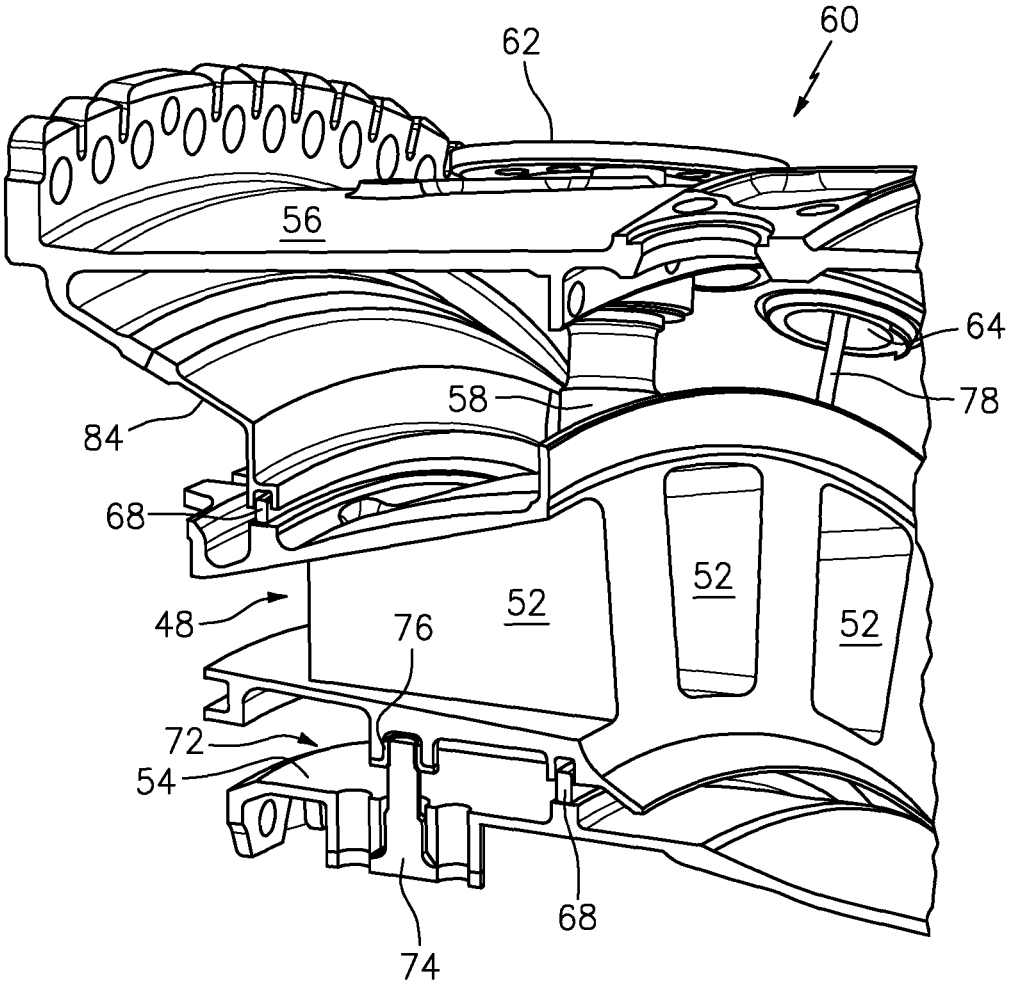
FIG. 4 is a cross-sectional perspective view of a portion of the diffuser case assembly of FIG. 2.

FIG. 2 illustrates a cross-sectional view of the gas turbine engine 10 illustrating the high-pressure compressor 40, the combustor 44, and the core flowpath C therebetween. An exit guide vane 46 is positioned within the core flowpath C immediately aft of the high-pressure compressor 40 and alters flow characteristics of core gases exiting the high-pressure compressor 40, prior to the gas flow entering the combustor 44.

Referring to FIGS. 2-5, a fairing 48 is disposed immediately aft of the exit guide vane 46 and forms at least a portion of the core flowpath C (i.e., a fluid path) between the high-pressure compressor 40 and the combustor 44. The fairing 48 is disposed circumferentially (e.g., annularly) about the longitudinal axis 24. The fairing 48 includes a plurality of fairing apertures 50. The fairing 48 may include a plurality of channels 52 extending (e.g., generally axially) through the fairing 48 and configured to form the core flowpath C through the fairing 48 between the high-pressure compressor 40 and the combustor 44. In some embodiments, each fairing aperture of the plurality of fairing apertures 50 may be disposed between each respective pair of circumferentially adjacent channels of the plurality of channels 52. In some embodiments, the fairing 48 may be configured as a single piece, for example a single-piece casting or a fully machined component. In some other embodiments, the fairing 48 may be configured as a plurality of circumferential segments subsequently assembled (e.g., welded or otherwise attached together) to form the fairing 48.

Annular inner and outer diffuser cases 54, 56 radially house the fairing 48. The outer diffuser case 56 is disposed radially outward of the fairing 48. The inner diffuser case 54 is disposed radially inward of the fairing 48. In some embodiments, the inner and outer diffuser cases 54, 56 may extend generally axially through all or part of the compressor section 14 and/or the combustor section 16. The inner and outer diffuser cases 54, 56 mechanically support structures of the gas turbine engine 10, for example, the inner diffuser case 54 may support a shaft bearing of the gas turbine engine 10.

At least one spoke 58 extends through a respective at least one fairing aperture of the plurality of fairing apertures 50. For example, each spoke of the at least one spoke 58 (e.g., 1, 2, 3, 4, or more spokes) may extend through a respective fairing aperture of the plurality of fairing apertures 50. In some embodiments, the at least one spoke 58 may be physically independent of the fairing 48 (i.e., there is no physical contact between the at least one spoke 58 and the fairing 48).

The at least one spoke 58 couples the inner diffuser case 54 to the outer diffuser case 56. The inner diffuser case 54, outer diffuser case 56, and at least one spoke 58 form a diffuser case assembly 60 (i.e., a "cold structure" in contrast to the "hot" fairing 48). In the illustrated embodiment, the at least one spoke 58 includes a coupler 62 which fastens to the outer diffuser case 56 and secures the at least one spoke 58 to the outer diffuser case 56 via a corresponding aperture 64 in the outer diffuser case 56. The at least one spoke 58 is secured to the inner diffuser case 54 by a plurality of fasteners 66 (e.g., bolts). The coupler 62 may have an external thread on the shank of the coupler 62 configured to be threaded into corresponding threads in the aperture 64 (i.e., the boss) of the outer diffuser case 56. The at least one coupler 62 may be threaded to different thread engagements to allow for centering of the inner diffuser case 54 about the axial centerline 24. The coupler 62 may include an anti-rotation feature, for example, one or more jack screws disposed about the perimeter of the coupler 62 (e.g., a flange portion of the coupler 62 in communication with the outer diffuser case 56).

In other embodiments, the at least one spoke 58 may be secured to the inner and outer diffuser cases 54, 56 by any suitable means. For example, the coupler 62 may be used to secure the at least one spoke 58 to one or both of the inner and outer diffuser cases 54, 56. Alternatively, in some embodiments, the coupler 62 may not be used.

During operational transients of the gas turbine engine 10, the fairing 48 may experience an increased flow of hot gases along the core flowpath C. For example, during a transient acceleration from idle to takeoff power, the increase flow of hot gases through the fairing 48 may cause the fairing 48 to rapidly increase in temperature. Separation of the core flowpath C from the diffuser case assembly 60 (i.e., the "cold structure") by the fairing 48 may prevent the development of large thermal gradients across the diffuser case assembly 60. As a result, the temperature of the fairing 48 may increase while the diffuser case assembly 60 remains at a more constant, lower temperature compared to the fairing 48. Thermal stress concentrations, for example, between the at least one spoke 58 and the inner diffuser case 54 may be reduced as a result of minimized thermal gradients across the diffuser case assembly 60.

The fairing 48 may include one or more seals 68, 70 between the fairing 48 and the diffuser case assembly 60. In the illustrated embodiment, the fairing 48 includes a seal 68 between the fairing 48 and the inner diffuser case 54. The fairing 48 includes an additional seal 68 between the fairing 48 and a seal carrier 84 extending from the outer diffuser case 56. The seals 68 may be configured to maintain the seal between the diffuser case assembly 60 and the fairing 48 as the fairing 48 expands and contracts (e.g., in a radial, axial, etc. direction), independent of the diffuser case assembly 60, as a result of changes in the temperature of the fairing 48. The seals 68 may be configured, for example, as piston seals or any other suitable type of seal. In other embodiments, the number and location of the seals 68 may vary according to diffuser case assembly 60 configuration. One or more cavities may be formed between the fairing 48 and the diffuser case assembly 60. For example, in the illustrated embodiment, an inner cavity 80 is defined by the fairing 48 and the inner diffuser case 54 while and outer cavity 82 is defined by the fairing 48 and the outer diffuser case 56.

The diffuser case assembly 60 may include at least one sliding joint 72 to provide a support interface between the fairing 48 and the diffuser case assembly 60, while still allowing the fairing 48 to thermally expand and contract. In the illustrated embodiment, the at least one sliding joint 72 includes an alignment pin 74 extending radially outward from the inner diffuser case 54. The alignment pin 74 mates with a pin bushing 76 disposed on the fairing 48 (i.e., a pin boss configuration), thereby movably supporting the fairing 48 by allowing relative radial movement between the fairing 48 and the alignment pin 74. For example, the alignment pin 74 may move radially within the pin bushing 76 in response to at least one of thermal expansion and contraction of the fairing 48 in a radial direction.

As discussed above, the gas turbine engine 10 transients may cause the fairing 48 to thermally expand or contract while the diffuser case assembly 60 maintains a more consistent and cooler temperature. Accordingly, in some embodiments, the at least one spoke 58 may be made from a first material while the fairing 48 is made from a second material, different than the first material. For example, the fairing 48 may be made from a high-temperature resistant material (e.g., waspaloy, nickel-based alloys, ceramics, ceramic matrix composites, etc.) while the at least one spoke 58 is made from a comparatively stronger material (e.g., Inconel 718, titanium, etc.) for improved support and structural stiffness of the diffuser case assembly 60.

In some embodiments, more than one spoke of the at least one spoke 58 may extend through a particular fairing aperture of the plurality of fairing apertures 50 for coupling the inner and outer diffuser cases 54, 56. In some other embodiments, no spokes of the at least one spoke 58 may extend through a particular fairing aperture of the plurality of fairing apertures 50.

In some embodiments, at least one auxiliary line 78 may extend through at least one fairing aperture of the plurality of fairing apertures 50. For example, the at least one auxiliary line 78 may be a bearing service line configured to convey oil to or from a bearing of the gas turbine engine 10.

Figure 5:
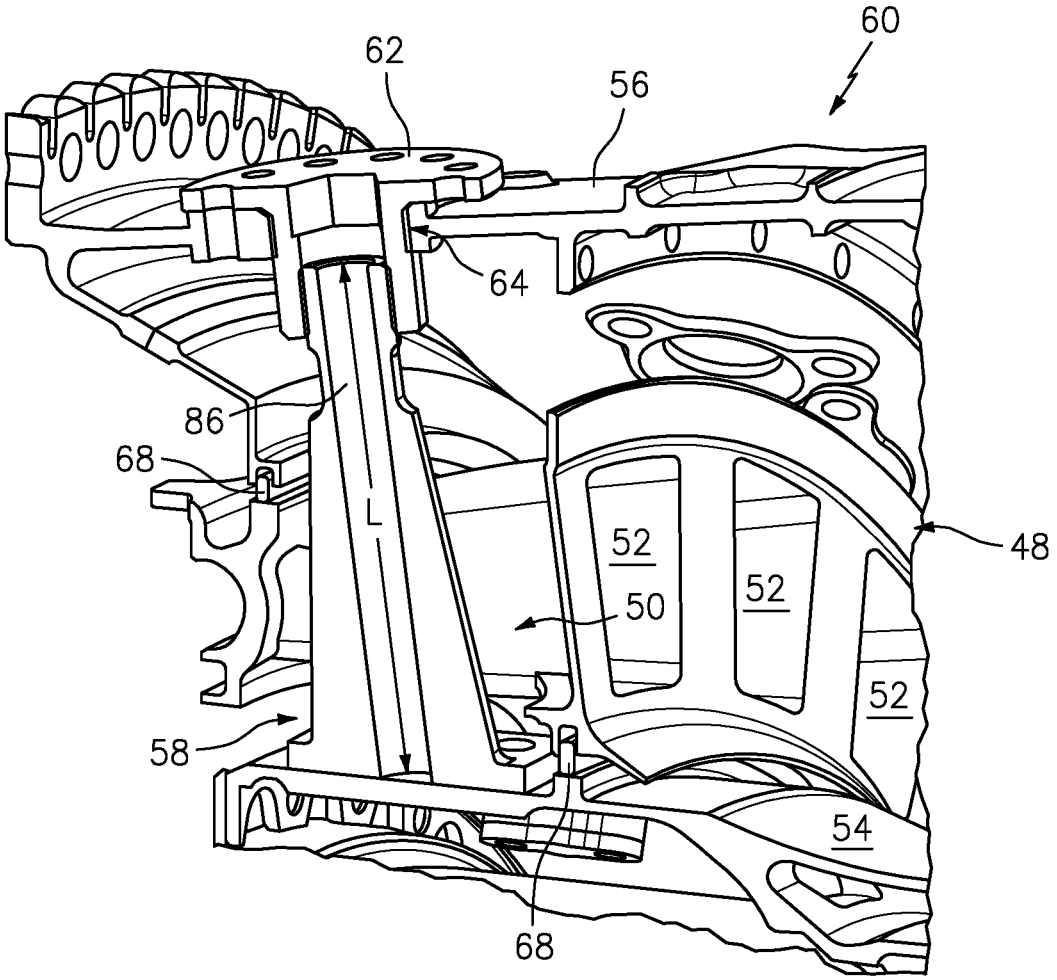
FIG. 5 is a cross-sectional perspective view of a portion of the diffuser case assembly of FIG. 2.

Referring to FIG. 5, the at least one spoke 58 may be hollow along at least a portion of a radial length L of the at least one spoke 58. A hollow configuration of the at least one spoke 58 may provide a reduction in the weight of the diffuser case assembly 60. One or more of the at least one spoke 58 may define a passage 86 configured to convey a fluid. In some embodiments, the passage of the at least one spoke 58 may convey a fluid (e.g., cooling air) between, for example, the outer diffuser case 56, the inner diffuser case 54, the outer cavity 82, and/or the inner cavity 80.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

What is claimed is:

1. A gas turbine engine comprising:

a compressor;

a combustor in fluid communication with the compressor; and a diffuser case support structure disposed between the compressor and the combustor, the diffuser case support structure comprising:

a fairing disposed circumferentially about a longitudinal axis and forming at least a portion of a fluid path between the compressor and the combustor, the fairing defining a plurality of apertures extending through the fairing; and at least one spoke extending through at least one respective aperture of the plurality of apertures;

wherein the at least one spoke is configured to couple an inner diffuser case and an outer diffuser case of the gas turbine engine.

2. The gas turbine engine of claim 1, wherein the fairing defines a plurality of channels, the plurality of channels forming the at least a portion of the fluid path between the compressor and the combustor.

3. The gas turbine engine of claim 2, wherein each aperture of the plurality of apertures is disposed between each respective pair of circumferentially adjacent channels of the plurality of channels.

4. The gas turbine engine of claim 1, wherein the at least one spoke comprises a plurality of spokes.

5. The gas turbine engine of claim 4, wherein each spoke of the plurality of spokes extends through a respective one of the plurality of apertures.

6. The gas turbine engine of claim 1, wherein the at least one spoke is physically independent of the fairing.

7. The gas turbine engine of claim 1, wherein the at least one spoke is made of a first material, and the fairing is made of a second material, different than the first material.

8. The gas turbine engine of claim 1, further comprising at least one seal disposed between the fairing and at least one of the inner diffuser case and the outer diffuser case.

9. The gas turbine engine of claim 1 further comprising a sliding joint forming an interface between the fairing and at least one of the inner diffuser case and the outer diffuser case.

10. The gas turbine engine of claim 9, wherein the sliding joint is configured to move radially in response to at least one of thermal expansion and contraction of the fairing in a radial direction.

11. The gas turbine engine of claim 1, wherein the at least one spoke is hollow along at least a portion of a radial length of the at least one spoke.

12. The gas turbine engine of claim 11, wherein the at least one spoke is configured to conduct a flow of fluid.

13. The gas turbine engine of claim 1, wherein an auxiliary line extends through an aperture of the plurality of apertures.

14. The gas turbine engine of claim 1, wherein the fairing is a single-piece casting.

15. A gas turbine engine having an engine central longitudinal axis, the gas turbine engine comprising:

a compressor;

a combustor; and a diffuser case support structure disposed axially between the compressor and the combustor, the diffuser case support structure comprising:

a fairing disposed circumferentially about a longitudinal axis, the fairing defining:

a plurality of apertures extending through the fairing; and a plurality of channels extending through the fairing, the plurality of channels forming at least a portion of a fluid path between a compressor and a combustor of the gas turbine engine; and at least one spoke extending through at least one respective aperture of the plurality of apertures;

wherein the at least one spoke is configured to couple an inner diffuser case and an outer diffuser case of the gas turbine engine.

16. The gas turbine engine of claim 15, wherein each aperture of the plurality of apertures is disposed between each respective pair of circumferentially adjacent channels of the plurality of channels.

17. The gas turbine engine of claim 15, wherein the at least one spoke is physically independent of the fairing.

18. A gas turbine engine having an engine central longitudinal axis, the gas turbine engine comprising:

an inner diffuser case;

an outer diffuser case; and a diffuser case support structure disposed radially between the inner diffuser case and the outer diffuser case, the diffuser case support structure comprising:

a fairing disposed circumferentially about a longitudinal axis and forming at least a portion of a fluid path between a compressor and a combustor of the gas turbine engine, the fairing defining a plurality of apertures extending through the fairing; and at least one spoke extending through at least one respective aperture of the plurality of apertures;

wherein the at least one spoke is configured to couple the inner diffuser case to the outer diffuser case.

19. The gas turbine engine of claim 18, wherein the fairing comprises a plurality of channels, the plurality of channels forming the at least a portion of the fluid path between the compressor and the combustor.

20. The gas turbine engine of claim 18, wherein the at least one spoke is physically independent of the fairing.

* * * * *